US012703545B2

(12) United States Patent
Barroso Machado

(10) Patent No.: US 12,703,545 B2
(45) Date of Patent: Aug. 11, 2026

(54) METALLIC OVERCAP WITH LATCHES

(71) Applicant: Gumercindo Barroso Machado, Juiz de Fora (BR)

(72) Inventor: Gumercindo Barroso Machado, Juiz de Fora (BR)

(73) Assignee: MODULO EMBALAGENS INDUSTRIA E COMERCIO LTDA, Matias Barbosa (BR)

( * ) Notice: Subject to any disclaimer, the term of this patent is extended or adjusted under 35 U.S.C. 154(b) by 0 days.

(21) Appl. No.: 17/311,517

(22) PCT Filed: Mar. 18, 2020

(86) PCT No.: PCT/BR2020/050095
§ 371 (c)(1),
(2) Date: Jun. 7, 2021

(87) PCT Pub. No.: WO2021/146784
PCT Pub. Date: Jul. 29, 2021

(65) Prior Publication Data

US 2022/0250807 A1 Aug. 11, 2022

(30) Foreign Application Priority Data

Jan. 24, 2020 (BR) ..... 102020 001640 7
Jan. 24, 2020 (BR) ..... 202020 001664 0

(51) Int. Cl.
*B65D 43/02* (2006.01)
*B65D 21/02* (2006.01)

(52) U.S. Cl.
CPC ..... *B65D 43/0214* (2013.01); *B65D 21/0217* (2013.01)

(58) Field of Classification Search
CPC .. B65D 41/17; B65D 34/0212; B65D 21/022; B65D 21/0222; B65D 21/0223; B65D 41/04; B65D 41/42; B65D 43/0212; B65D 43/0214; B65D 43/0222; B65D 43/0231; B65D 43/12; B65D 41/12; B65D 41/16
USPC ..... 220/796
See application file for complete search history.

(56) References Cited

U.S. PATENT DOCUMENTS 1,516,046 A * 11/1924 Nixon ..... B65D 41/0471 215/331
1,667,003 A * 4/1928 Hardiman ..... B65D 41/04 215/333
1,941,049 A * 12/1933 Punte ..... B65D 43/0222 220/806

(Continued)

FOREIGN PATENT DOCUMENTS

GB 201899 A 3/1924

OTHER PUBLICATIONS

International Search Report for PCT/BR2020.050095 mailed Aug. 21, 2020 (3 pages).

*Primary Examiner* — Andrew T Kirsch
(74) *Attorney, Agent, or Firm* — Merchant & Gould P.C

(57) ABSTRACT

The present invention relates to a metallic overcap with latches, being applied in packaging with lids, which closes and guarantees the tightness of the packaging, allowing for retamping and guaranteeing the useful life of the filled product after opening the primary cover in packaging. of different types of materials, such as: steel, aluminum, fibralate, plastic, among others.

10 Claims, 7 Drawing Sheets

(56) References Cited

U.S. PATENT DOCUMENTS

| | | | | | |
|---|---|---|---|---|---|
| 1,990,744 | A * | 2/1935 | Merolle | B65D 41/04 | 220/293 |
| 2,181,179 | A * | 11/1939 | Eccleston | B65D 41/04 | 220/293 |
| 2,205,685 | A * | 6/1940 | Conner | B65D 43/0233 | 206/508 |
| 2,317,287 | A * | 4/1943 | Mccombs | B65D 41/16 | 413/8 |
| 3,071,275 | A * | 1/1963 | Foss | B65D 41/02 | 215/317 |
| 3,494,497 | A * | 2/1970 | Vercillo | B65D 41/0442 | 215/318 |
| 3,532,224 | A | 10/1970 | Grubb et al. | | |
| 3,840,152 | A | 10/1974 | Hodge | | |
| 4,081,098 | A * | 3/1978 | Johansson | B65D 41/0485 | 215/329 |
| 4,625,890 | A | 12/1986 | Galer | | |
| 5,307,945 | A * | 5/1994 | Hidding | B65D 41/3409 | 215/337 |
| 7,946,443 | B2 | 5/2011 | Stull et al. | | |
| 9,096,356 | B2 * | 8/2015 | Bates | B65D 41/0464 | |
| 9,150,328 | B2 * | 10/2015 | Dunn | B65D 7/36 | |
| 9,349,332 | B2 | 5/2016 | Hsu et al. | | |
| 2011/0005292 | A1 | 1/2011 | Futagi et al. | | |

* cited by examiner

METALLIC OVERCAP WITH LATCHES

This application is a National Stage Application of PCT/BR2020/050095, filed 18 Mar. 2020, which claims benefit of Serial No. 10 2020 001640 7, and BR 20 2020 001664 0, filed 24 Jan. 2020 in Brazil and which application are incorporated herein by reference. To the extent appropriate, a claim of priority is made to each of the above disclosed applications.

BACKGROUND OF THE INVENTION

The present invention refers to a metallic overcap with latches, being applied in packaging with lids, which closes and guarantees the hermeticity of the packaging, allowing for retamping and guaranteeing the useful life of the bottled product after opening the lid. primary in packaging of different types of materials, such as: steel, aluminum, fibralate, plastic, among others.

The present invention is a harmonization of patent applications that make up BR 102020001640-7 and BR 202020001664-0 as unionist priorities.

Where BR 102020001640-7 claims METAL OVERCOM WITH BRAKES and BR 202020001664-0 claims CONFIGURATION APPLIED IN METAL OVERCOM.

TECHNICAL STATUS

Some documents dealing with this matter are known to the state of the art, such as PI 9900361-9 deposited on Jan. 29, 1999 and named "Container with metallic body and plastic cover ring and overcap" which refers to a packaging suitable mainly for the food segment, composed of a body made of tinplate, chrome-plated sheet or black plate provided with a concave channel, in which a plastic ring that receives the sealing seal forming the tamper-proof lid, and an overcap fitting externally to the body's concave channel, with the function of closing the container after the sealing seal breaks.

SUMMARY OF THE INVENTION

The overcap is produced in sheet metal by stamping process, forming a metal disc, where the material is wound at the end of the disc. The cord formed at the peripheral end of the overcap is partially dented (3) in a segmented way along the edge of the overcap, making the preserved stretches of the cord constitute latches (1) that guarantee the fixation of the caps on the edge of the upper seam (9), however, in the stamping process, the disc may receive recesses or protuberances so that the top face of the overcap fits into the bottom of the package (6) and thus optimizing the stacking of the product or for structural reinforcement.

After stamping, a seal is added on the inside face of the overcap, in the region that will be in contact with the upper seam edge (9) with the packaging body (5) in order to seal the packaging and thus guaranteeing better preservation of the product after opening the primary cover (4).

The adopted seal is of the plastisol type or similar, applied on the periphery of the underside of the overcap, in the region where it touches the top of the seam (9) of the packaging body (5), enhancing the overcap sealing and can be applied to different types of cover: sealed safe, easy-open, etc.

DESCRIPTION OF THE DRAWINGS

The description that follows and the associated figures, all given by way of non-limiting example, will make the invention well understood.

Figure 1:
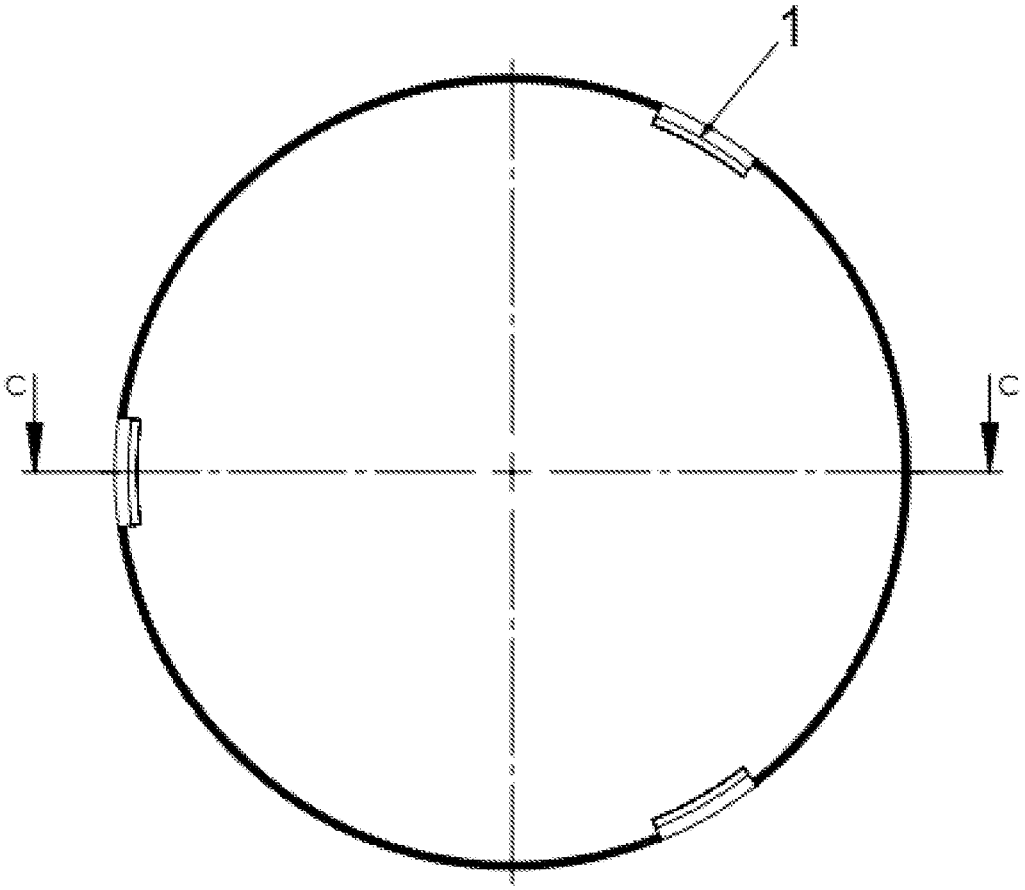
FIG. 1 represents a top view of the metallic overcap with locks.
Figure 2:
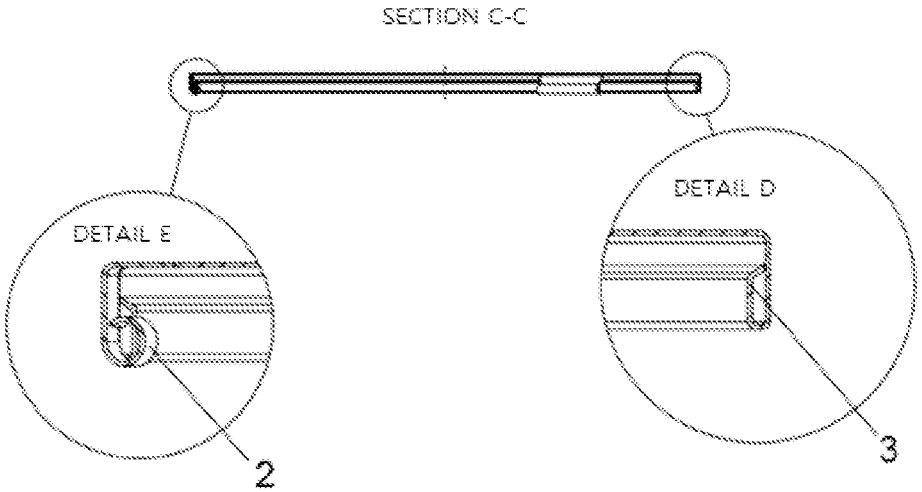
FIG. 2 represents a view of section C-C, shown in FIG. 1, with details of the edges of the metallic overcap with locks.
Figure 3:
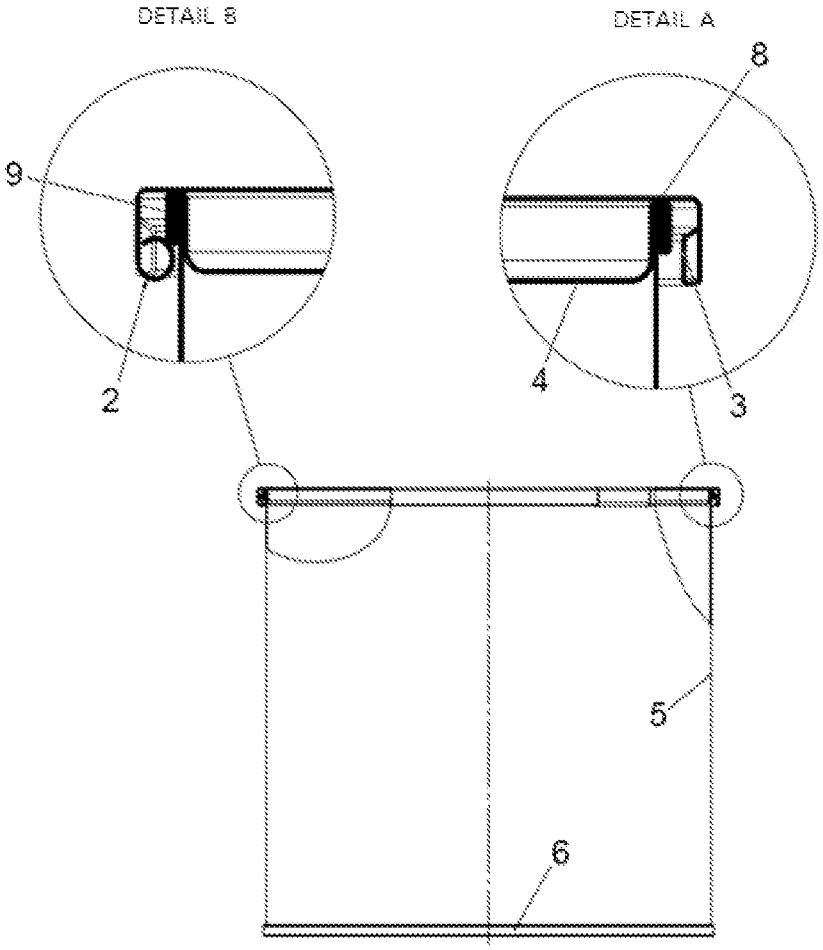
FIG. 3 represents a view of section C-C, shown in FIG. 1, of the packaging with metallic overcap with lock.
Figure 4:
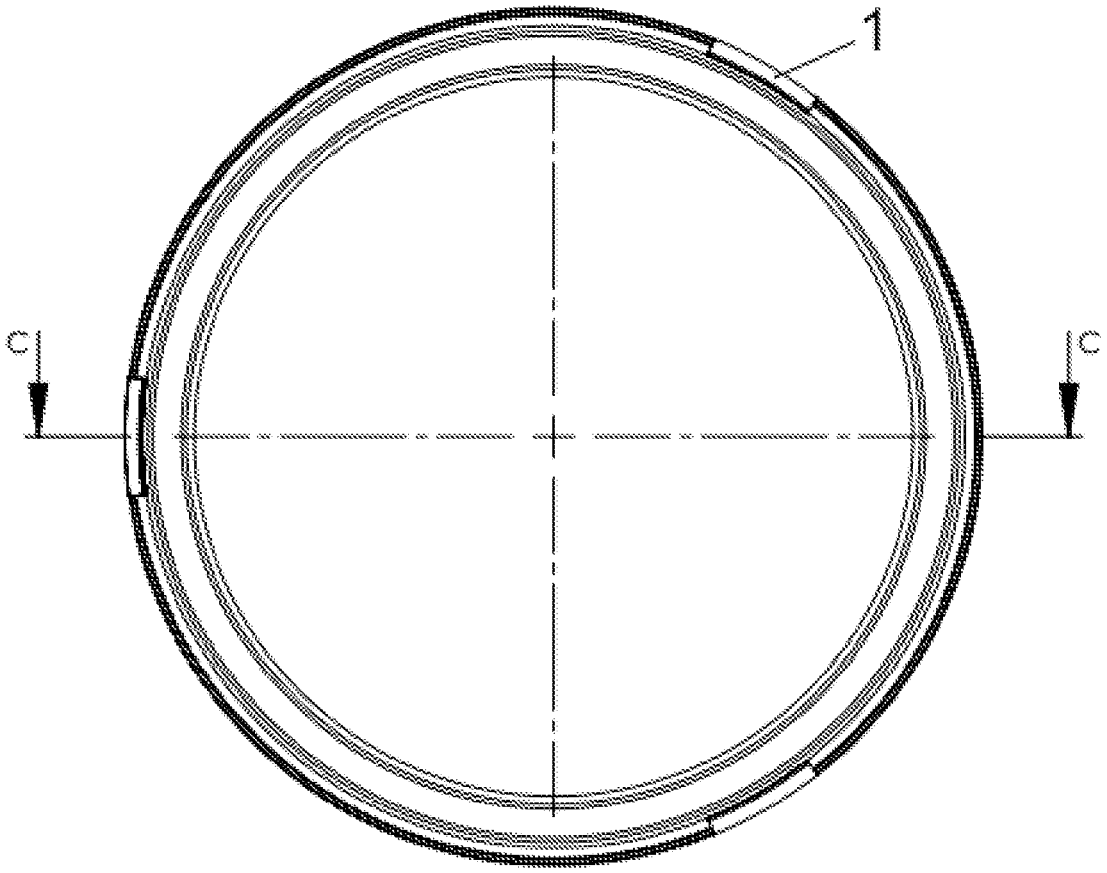
FIG. 4 represents a top view of a metallic overcap with relief for stacking (7).
Figure 5:
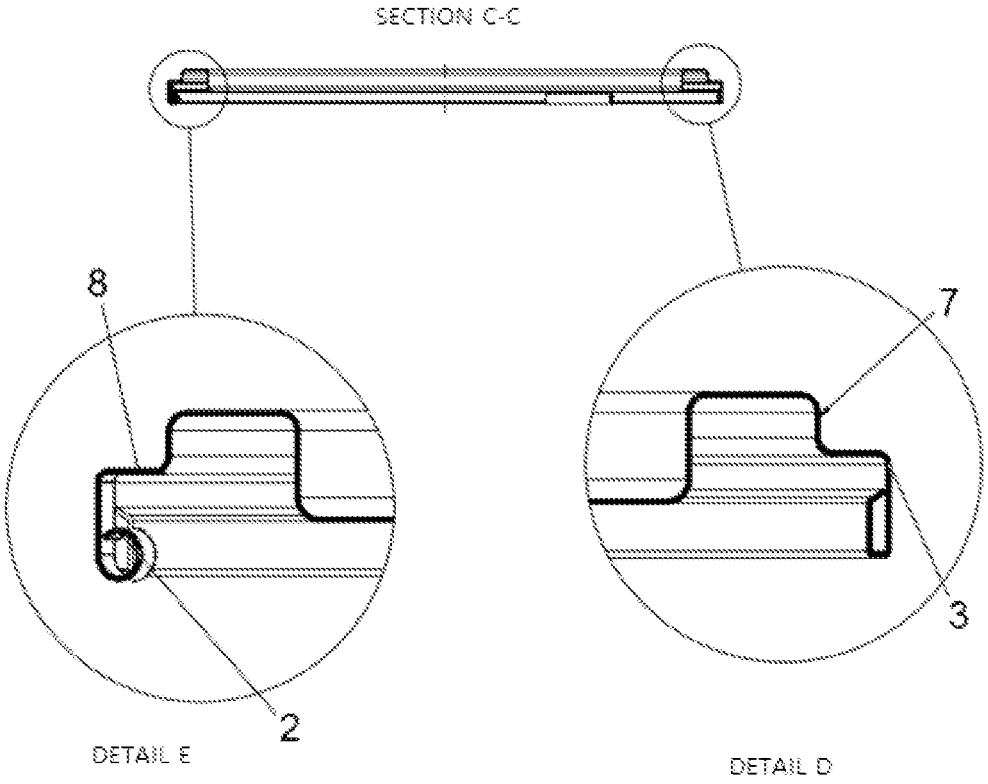
FIG. 5 represents a view of section C-C, shown in FIG. 1, with details of the edges of the metallic overcap with relief for stacking (7).
Figure 6:
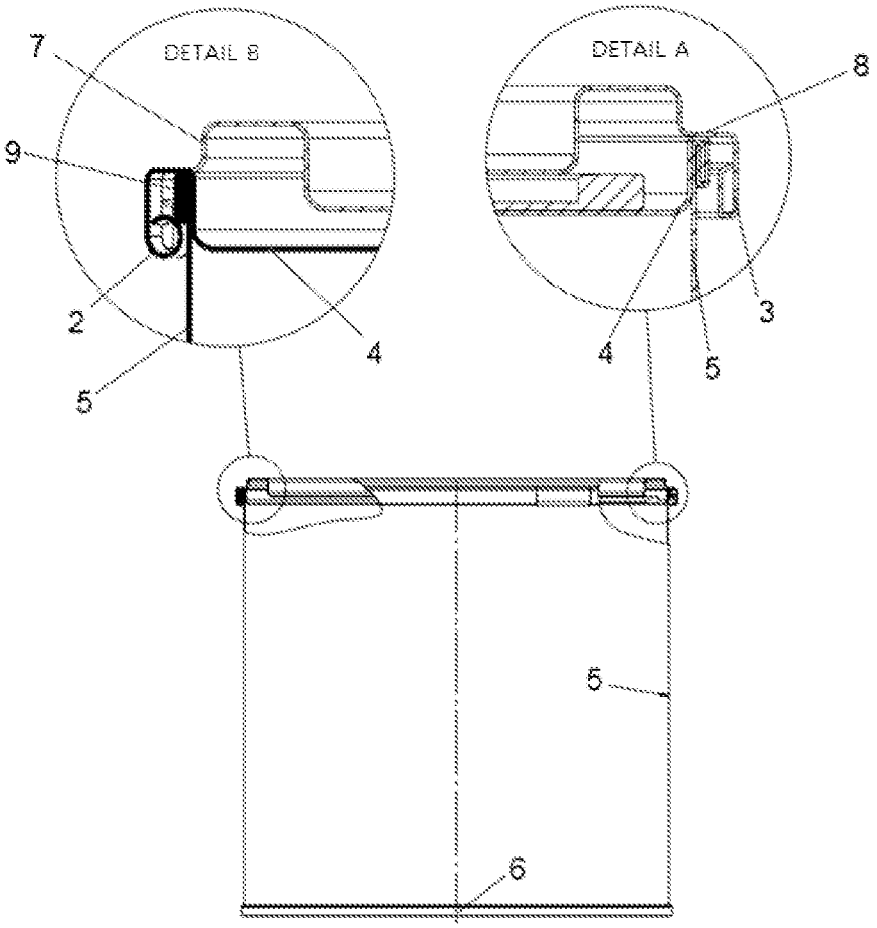
FIG. 6 represents a view of section C-C, shown in FIG. 1, of the packaging with metallic overcap with relief for stacking (7).
Figure 7:
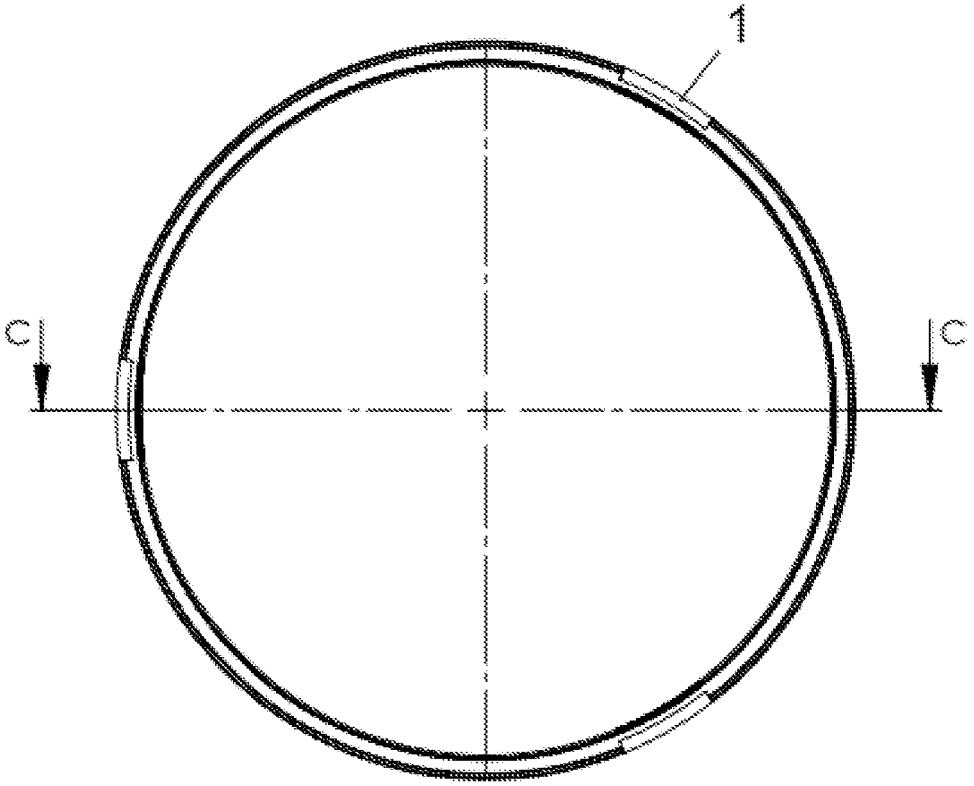
FIG. 7 represents a top view of a reinforced metallic overcap (7).
Figure 8:
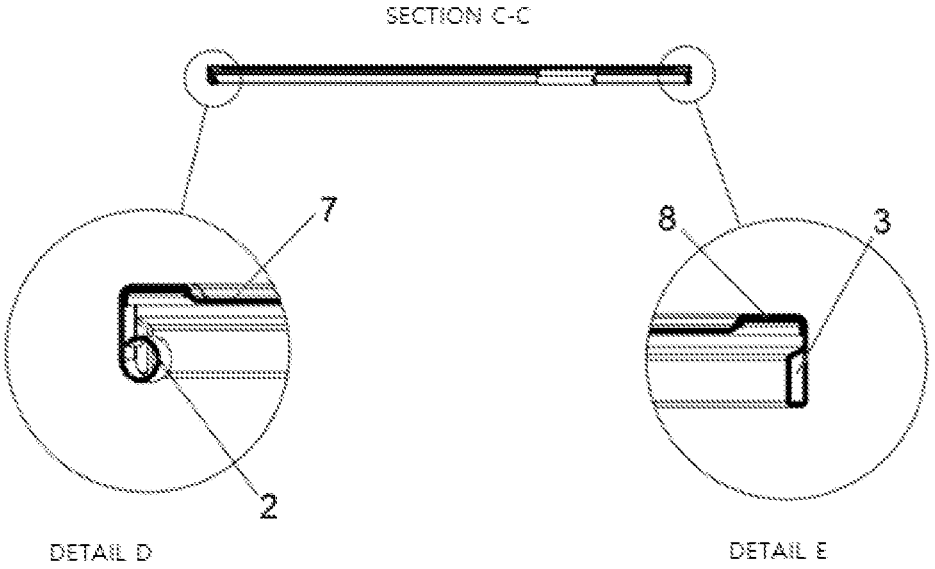
FIG. 8 represents a view of section C-C, shown in FIG. 4, with details of the edges of the reinforced metallic overcap (7).
Figure 9:
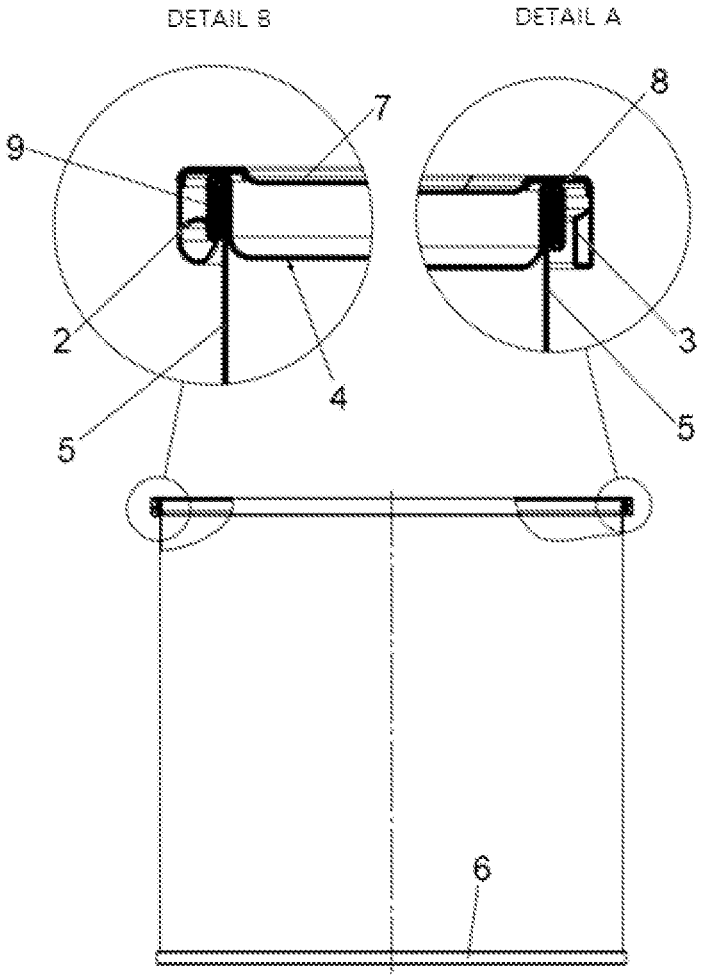
FIG. 9 represents a view of section C-C, shown in FIG. 4, of the packaging with metallic overcap with reinforcement (7).

The present overcap comprises a flattened edge (3) with a plurality of segments for locking (1) with a rounded edge (2), fitting into the packing body (5) due to friction between the rounded edges (2) of the locking segments (1) and the upper seaming edge (9) and the packing body (5).

The adoption of partial kneading of the overcap cord produces recesses in segmented stretches along the edge of the overcap, giving the metal cap some flexibility, making it capable of adjusting to various diameters resulting from the tolerances of a standardized seaming process.

After removing the primary lid (4), this metallic overcap allows the packaging to be retrofitted, guaranteeing the useful life of the bottled product after opening the primary lid (4).

To achieve this result, the overcap is manufactured through the stamping process, curling the edges of the sheet metal disc, resulting in a rounded finish (2), followed by kneading (3) in a segmented way along the edge of the cap, making the preserved stretches of the cord (1) constitute locks for fixing the overcap on the seam edge of the packing body (5).

LIST OF REFERENCES (1) Locking segment;
(2) Rounded edge;
(3) Flattened edge;
(4) Primary lid;
(5) Packing body;
(6) Bottom of the packaging;
(7) Reinforcement/Relief for stacking;
(8) Sealant layer;
(9) Upper seam edge.

The invention claimed is:

1. A metallic overcap with latches that is configured to reseal a packaging body after the packaging body is opened, the metallic overcap comprising:

a sheet metal disc with a plurality of locking segments on an edge thereof, the locking segments are formed by a stamping process, the locking segments have rounded edges, and the edge of the sheet metal disc further includes flattened edges between the rounded edges of the locking segments, the locking segments and the flattened edges do not circumferentially overlap one another, the flattened edges are radially inwardly facing, and the sheet metal disc further includes a reinforcement on an upper surface thereof adjacent to the edge, each one of the locking segments includes a first end and a second end, and each first end and each second end are spaced a same distance from the upper surface;

each one of the locking segments includes an upper edge that extends from the first end to the second end thereof, and each upper edge is a constant distance from the upper surface; and each one of the locking segments includes a bottom edge that extends from the first end to the second end thereof, and each bottom edge is a constant distance from the upper surface;

wherein when the metallic overcap is fitted onto the packaging body, the rounded edges of the locking segments and the reinforcement frictionally engage with the packaging body.

2. The metallic overcap of claim 1, wherein:

each one of the flattened edges includes an upper edge that extends from one end thereof to an opposite end thereof, the upper edge of each flattened edge is a constant distance from the upper surface;

each one of the flattened edges includes a bottom edge that extends from one end thereof to an opposite end thereof, the bottom edge of each flattened edge is a constant distance from the upper surface; and the upper edge of each flattened edge is positioned closer to the upper surface than is the upper edge of each locking segment.

3. The metallic overcap of claim 1, wherein each flattened edge has an arc length that is greater than an arc length of each locking segment.

4. The metallic overcap of claim 3, wherein the flattened edges have a total arc length that is greater that a total arc length of the locking segments.

5. The metallic overcap of claim 1, wherein in a top view of the metallic overcap, a radial axis that extends through one of the locking segments does not extend through another one of the locking segments.

6. A metallic overcap with latches that is configured to reseal a packaging body after the packaging body is opened, the metallic overcap comprising:

a sheet metal disc with a plurality of locking segments on an edge thereof, the locking segments have rounded edges, and the edge of the sheet metal disc further includes flattened edges between the rounded edges of the locking segments, the locking segments and the flattened edges do not circumferentially overlap one another, the flattened edges are radially inwardly facing, and the sheet metal disc further includes an upper surface;

each one of the locking segments includes a first end and a second end, and each first end and each second end are spaced a same distance from the upper surface;

each one of the locking segments includes an upper edge that extends from the first end to the second end thereof, and each upper edge is a constant distance from the upper surface; and each one of the locking segments includes a bottom edge that extends from the first end to the second end thereof, and each bottom edge is a constant distance from the upper surface;

wherein when the metallic overcap is fitted onto the packaging body, the rounded edges of the locking segments frictionally engage with the packaging body.

7. The metallic overcap of claim 6, wherein:

each one of the flattened edges includes an upper edge that extends from one end thereof to an opposite end thereof, the upper edge of each flattened edge is a constant distance from the upper surface;

each one of the flattened edges includes a bottom edge that extends from one end thereof to an opposite end thereof, the bottom edge of each flattened edge is a constant distance from the upper surface; and the upper edge of each flattened edge is positioned closer to the upper surface than is the upper edge of each locking segment.

8. The metallic overcap of claim 6, wherein each flattened edge has an arc length that is greater than an arc length of each locking segment.

9. The metallic overcap of claim 8, wherein the flattened edges have a total arc length that is greater that a total arc length of the locking segments.

10. The metallic overcap of claim 6, wherein in a top view of the metallic overcap, a radial axis that extends through one of the locking segments does not extend through another one of the locking segments.

* * * * *